United States Patent [19]

Pamer

[11] Patent Number: 4,531,460

[45] Date of Patent: Jul. 30, 1985

[54] MATERIAL HANDLING SYSTEM

[75] Inventor: Karl A. Pamer, Chagrin Falls, Ohio

[73] Assignee: Litton Systems, Inc.

[21] Appl. No.: 356,816

[22] Filed: Mar. 10, 1982

[51] Int. Cl.[3] ..... B61B 3/02; B61C 13/04

[52] U.S. Cl. ..... 105/150; 104/93; 104/95; 104/107; 104/110; 105/154

[58] Field of Search ..... 104/89, 93, 95, 106, 104/107, 110; 105/148, 150, 152, 154

[56] References Cited

U.S. PATENT DOCUMENTS

| | | | |
|---|---|---|---|
| 914,443 | 3/1909 | Myers | 104/107 |
| 1,178,196 | 4/1916 | Willard | 104/107 |
| 2,470,060 | 5/1949 | Webb et al. | 105/152 X |
| 2,985,113 | 5/1961 | Cotesworth | 105/154 X |
| 3,202,259 | 8/1965 | Orwin | 104/93 X |
| 3,563,179 | 2/1971 | Gorjanc | 104/95 |
| 3,625,158 | 12/1971 | Lorenz et al. | 104/110 X |
| 3,855,941 | 12/1974 | Fromme et al. | 104/93 X |

FOREIGN PATENT DOCUMENTS

| | | | |
|---|---|---|---|
| 2503487 | 8/1976 | Fed. Rep. of Germany | 105/150 |
| 2913543 | 10/1979 | Fed. Rep. of Germany | 104/93 |
| 441942 | 1/1936 | United Kingdom | 105/154 |

OTHER PUBLICATIONS

Catalog entitled "Stahl Hangebahnsystem HS".
Catalog entitled "Demag, Einschienen-Hangebahnen".
Catalog entitled "Tourtellier, Polyrail".
Catalog entitled "Translift-Tomorrow's Handling Systems".
Catalog entitled "Thyssen, Monorail Electrique".
Catalog entitled "Autotrac Light Capacity Automatic Monorail System".
Catalog entitled "Railmatic, Monorails Electriques".

*Primary Examiner*—Randolph Reese
*Attorney, Agent, or Firm*—Morris I. Pollack

[57] ABSTRACT

A material handling system of the monorail and crane type is adaptable to carry relatively heavy loads and light loads through convenient structural modification using common component parts. The system is comprised of a double track 40 for heavy loads, formed of two track parts 54, 55 that alone are suitable for light-load applications. Carriers 42, 204 are comprised of drive heads 74 and idler heads 78, each with a single load support wheel 70, 71 or 70', 71'. A drive head 74, 74' and an idler head 78, 78' can be releasably interconnected in tandem by a load bar 206 to run along a single track, or in face-to-face opposition with wheels 70, 71 coaxial to form a drive unit 44 adapted to run along a double track. In the latter arrangement two additional heads, such as two idler heads **78*b*, 78*c*, are also interconnected in face-to-face opposition to form an idler unit 46 and connected in tandem with the drive unit 44 by a load bar 52.**

16 Claims, 36 Drawing Figures

MATERIAL HANDLING SYSTEM

DESCRIPTION

1. Technical Field

This invention relates to material handling systems of the track and motor-driven carrier type, especially monorail and crane-type systems.

2. Background Art

Crane and monorail systems typically use steel I-beam tracks for heavy-duty, high-load applications, and rolled or extruded track for lighter-load applications. Heavy-duty carriers typically have pairs of wheels that ride on lower flanges of the I-beams, on opposite sides of the beam web. Lighter-load carriers commonly have two tandem wheels that ride on a single track surface, sometimes using wheels with concave surfaces that run along convex tracks, and with guide wheels cooperating with vertical track surfaces to maintain carrier alignment and stability. A user chooses between a heavy-duty, high-load system and a lighter-load system, based upon the particular application, but cannot readily modify the choice from one to the other. Rather, manufacturers typically offer separately designed systems in which the component parts of the heavy-duty system are not compatable with a lighter-load system.

DISCLOSURE OF THE INVENTION

The present invention relates to a material handling system of the monorail and crane type that is adaptable to relatively heavy loads and light loads, through convenient structural modification using common component parts, thereby providing substantial advantages to both the manufacturer and the user.

The system includes a track for systems that handle heavy loads that is symmetrical about a vertical plane. It is fabricated from two identical parts connected to form a modified I-beam shape, with flat side-by-side track surfaces that support the wheels of a carrier. The track surfaces extend laterally from vertical web portions and at their outer edges have a depending guide flange. The vertical webs terminate at their upper ends in side-by-side channels that open toward the respective wheel supporting surfaces and which are used to suspend the track, to house guide rollers, and in one embodiment, to house current carriers.

The two track-forming parts also individually form a supporting and guiding track for a lighter-load monorail system in which tandem wheels of a carrier run on the single track surface to one side of the vertical web portion and in which the upper channel and lower flange form guide surfaces for carrier guide rollers. The shape of each single track part thus forms a track suitable for both the heavy-load and the light-load systems.

The system includes a load carrier with a motor-driven unit and an idler unit, connected in tandem by a load bar. The motor-driven unit and the idler unit have double load-supporting wheels cooperating with a double track for heavy duty use, and single load supporting wheels cooperating with a single track surface that comprises half of the double track for lighter-load applications.

The carriers consist of two basic wheeled members: a drive head and an idler head. Each of these heads has a single load-supporting wheel and is constructed and arranged to be interconnected with another head. Specifically, two heads can be connected with the wheels in facing opposition and coaxial, to form a double-wheel unit in which the wheels run on parallel side-by-side wheel-supporting surfaces. Such a unit is used with a second double-wheel unit connected in tandem. At least one of the units includes a drive head. Alternatively, a single-wheel drive head and single-wheel idler head can be connected in tandem to run along a single track, and providing half the load-carrying capacity of the double-wheel carrier. From the above it will be understood that the track and carrier system provides flexibility that, with the same drive heads, idler heads and track members, can provide either a light-load monorail system or a heavy-load crane or monorail system.

The above and other features and advantages of the present invention will become more apparent from the detailed description that follows when considered in connection with the accompanying drawings.

BRIEF DESCRIPTION OF THE DRAWINGS

FIG. 24 is an end elevational view of a single-track drive head with a single-track guide wheel adapter, FIG. 25 is an end elevational view of a drive head and idler head combined with a double-track guide wheel adapter for use on a double track.

FIG. 26 is an elevational view of the drive head of FIG. 25 taken along the line 26—26, FIG. 27 is an elevational view of the idler head of FIG. 25 taken along the line 27—27, FIG. 28 is a partial plan view of the single track adapter taken from the line 28—28 of FIG. 24, FIG. 29, is a side elevational view of the adapter of FIG. 28, FIG. 30 is a partial plan view of the double track adapter of FIG. 25 taken along the line 30—30, FIG. 31 is an end elevational view of the adapter of FIG. 30, and FIG. 32 is a side elevational view of the adapter of FIG. 30;

BEST MODE FOR CARRYING OUT THE INVENTION

Figure 1:
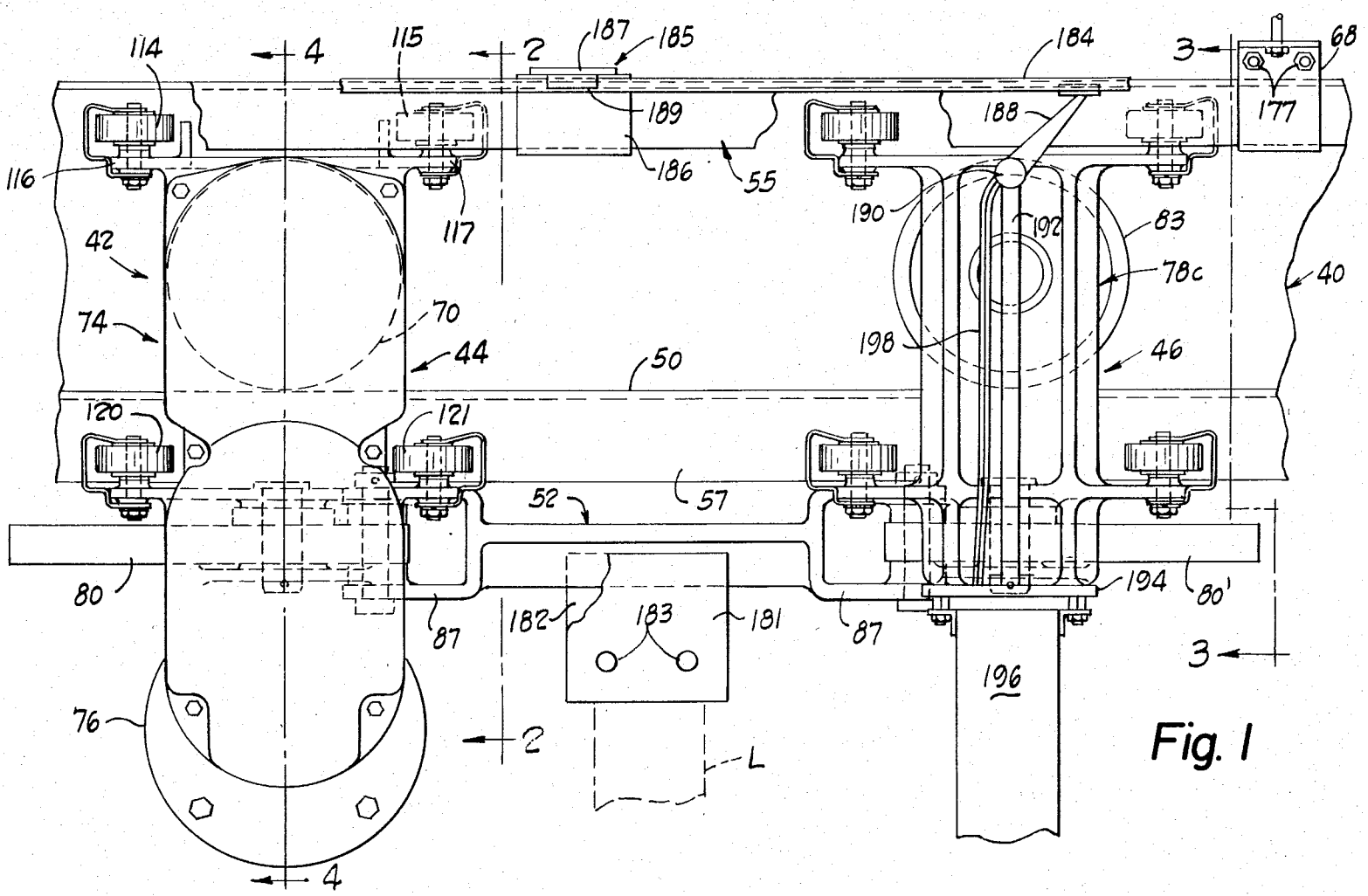
FIG. 1 is a side elevational view of a material handling system emboding the present invention, utilizing a double track and a carrier with a double-wheel drive unit and double-wheel idler unit.

One embodiment of the invention is a track and carrier system of the monorail type shown in FIGS. 1 to 10 of the drawings. The system is comprised of a double track 40 and a carrier 42 having a drive unit 44 and an idler unit 46 connected in tandem, each with two load carrying wheels, one riding on each of two support surfaces 48, 50 of the double track. A load bar 52 connects the drive unit and idler unit and supports a load L between the two units. The system 42 has a relatively high weight capacity because of the four support wheels of the carrier and the strength and rigidity of the double track 40.

Figure 2:
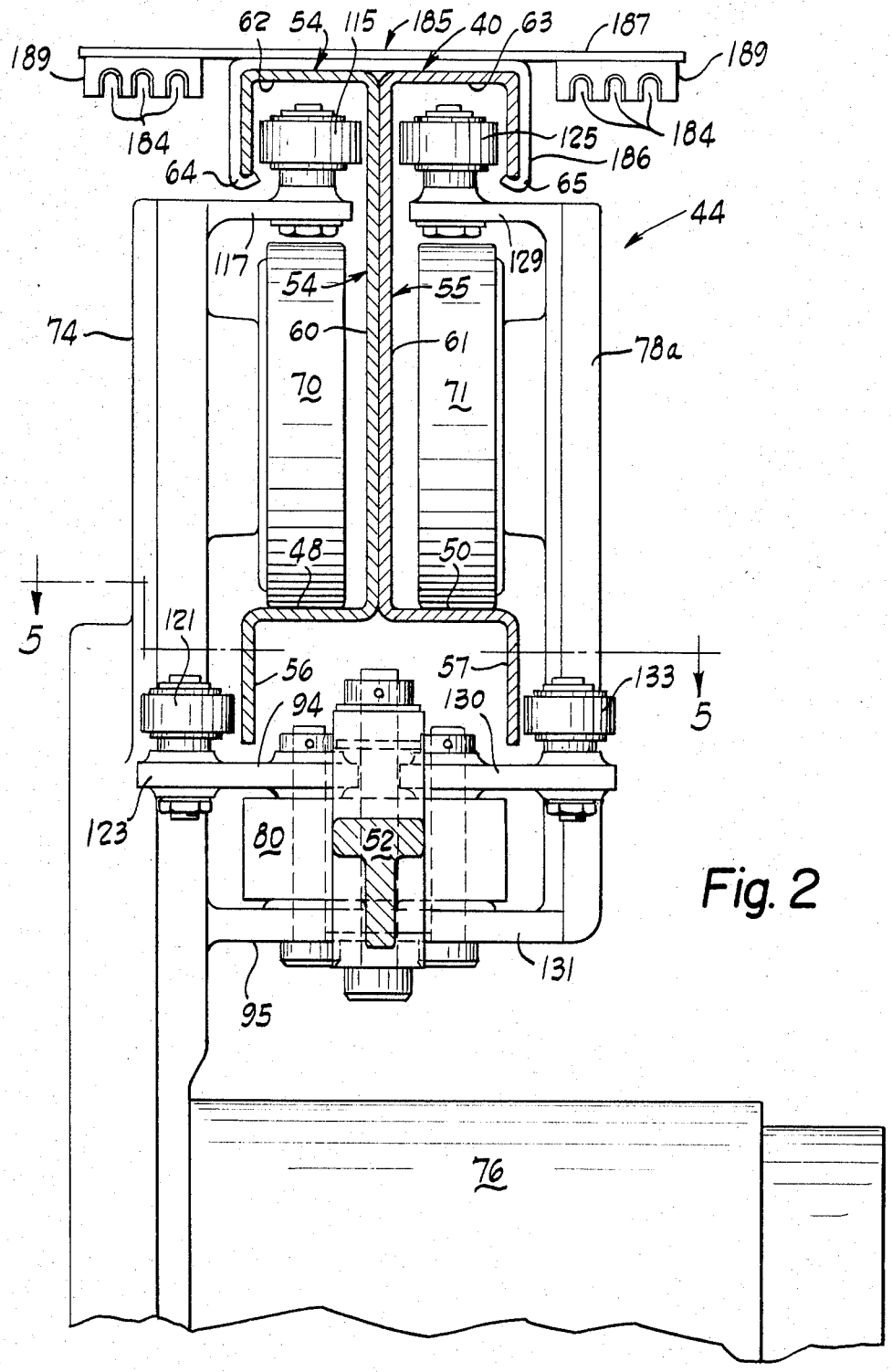
FIG. 2 is an end elevational view of a portion of the unit of FIG. 1, taken along the line 2—2.

The double track 40 is best shown in FIGS. 1 and 2 and is comprised of two identical single-track members 54, 55. The member 54 includes the wheel support surface 48 and the member 55 includes the wheel support surface 50. A guide flange 56 extends vertically downward in the orientation of FIG. 2 from one side edge of the support surface 48 at a right angle for cooperating with guide wheels of the carrier. A similar flange 57 extends vertically downward from one side edge of the support surface 50 of the track 55. A supporting web 60 extends vertically upward in the orientation of FIG. 2 from the support surface 48 along an opposite longitudinal side edge from the guide flange 56 and for a substantially greater distance, as well as for a greater distance than the width of the support surface 48. A similar web 61 extends from the support surface 50 along an opposite edge from the guide flange 57 and in the preferred embodiment is positioned directly against the web 60, secured as by spot welding. A channel 62 is formed at the upper end of the supporting web 60, parallel to and opening downward toward the support surface 48. A similar channel 63 is formed along the upper edge of the supporting web 61 parallel to and opening downward toward the support surface 50. The channel 62 terminates in a longitudinal edge 64 and the channel 63 terminates in a longitudinal edge 65, both of which serve when engaged by a suitable bracket 68 (FIGS. 1 and 10) to support the double track from an overhead suspension. It will be apparent that each track member 54, 55 is identical, but is arranged back-to-back, in mirror image relationship, i.e., with the supporting webs 60, 61 adjacent to each other and between the two support surfaces 48, 50.

The drive unit 44, which serves to propel the carrier along the track 40, has two load-bearing support wheels 70, 71 that run on the support surfaces 48, 50, respectively. The support wheel 70 is part of a drive head 74 that carries an electric motor 76 for driving the wheel 70. The wheel 71 is part of an idler head 78*a*. The drive head 74 and idler head 78*a* are interconnected beneath the track by an adapter or linking member 80, as shown in FIGS. 2, 4 and 5, to form the drive unit 44.

The idler unit 46 (FIG. 3) has two load-supporting wheels 71*b*, 71*c* that are supported on the track surfaces 48, 50, respectively. Each wheel is part of an idler head 78*b*, 78*c* identical to the idler head 78*a* of the drive unit. The two idler heads 78*b*, 78*c* are interconnected by an adapter 80′, identical to the adapter 80, to form the idler unit in the same manner as is illustrated in FIG. 5 in connection with the drive unit 44. The two adapters 80, 80′ are connected by the load bar 52, which has a clevis 87 on each end that allows relative pivoting.

Figure 4:
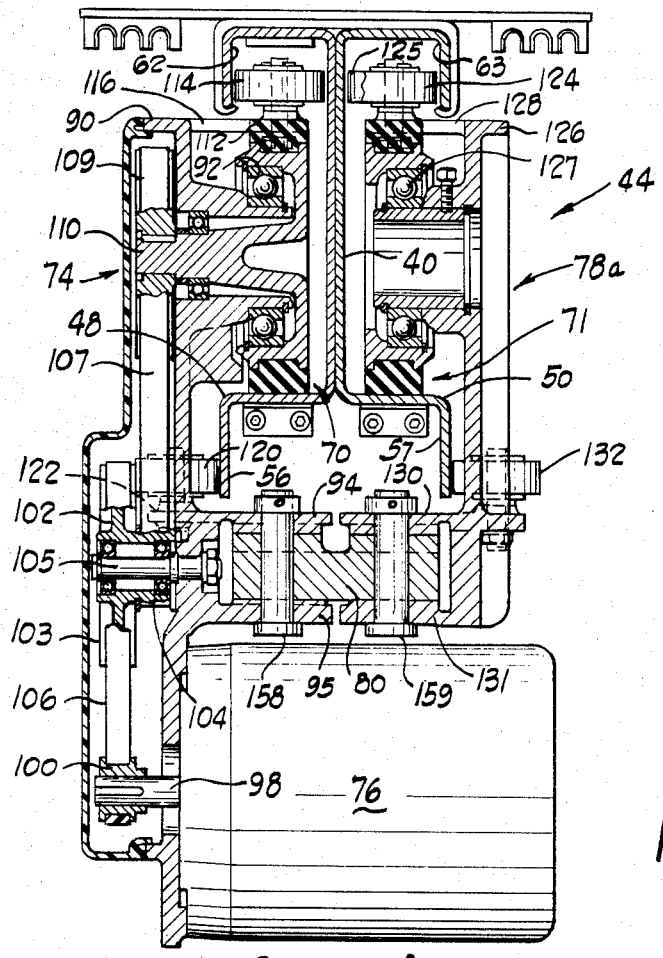
FIG. 4 is a sectional view taken along the line 4—4 of FIG. 1.
Figure 5:
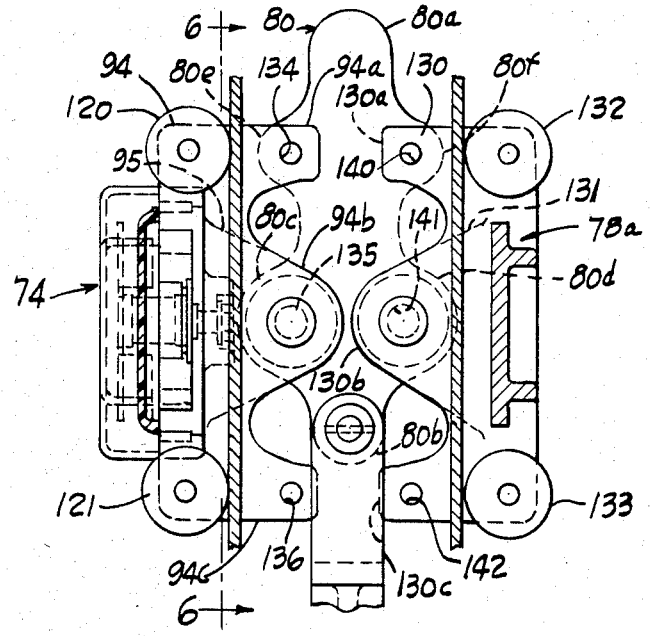
FIG. 5 is a sectional view taken along the line 5—5 of FIG. 2.
Figure 6:
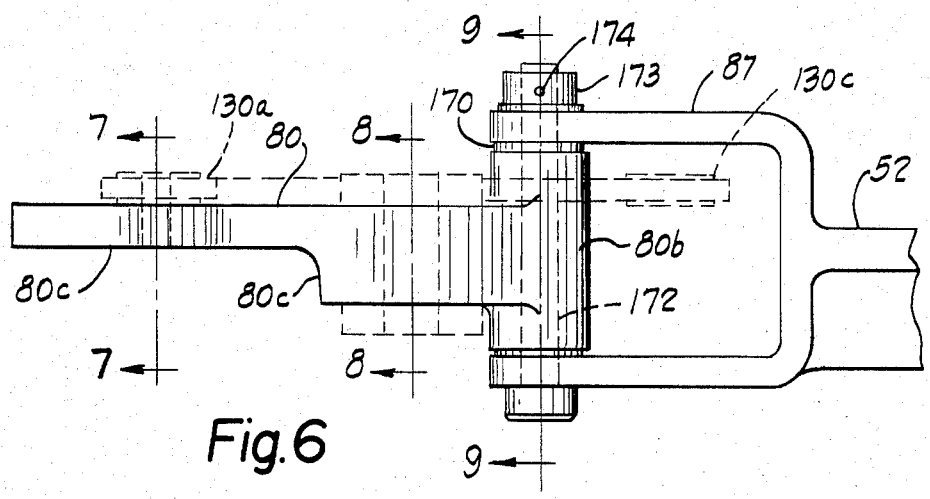
FIG. 6 is a side elevational view of an adapter for joining a drive head and idler head as viewed from the line 6—6 of FIG. 5, with parts removed and showing an interconnection with a load bar.

The construction of the drive head 74 and the idler head 78*a* is shown in more detail in FIG. 4.

The drive head 74 is comprised of a metal casting 90 in which the load-bearing drive wheel 70 is journaled by a support bearing 92 at the upper portion of the casting. The electric motor 76, along with a connected motor brake, is attached to the casting at the lower portion, at a level beneath the supporting track 40. The wheel 70 projects laterally from the casting, to be received on the support surface 48 of the track while the casting depends from the wheel alongside the guide flange 56. The casting has two vertically spaced, parallel, horizontal flanges 94, 95 that extend toward the center of the track, beneath the track and above the drive motor 76. The flanges have the dual purpose of interconnecting the drive head to the idler head through the adapter 80, and alternatively (as will be described in connection with FIGS. 11 to 17) of supporting guide rollers to cooperate with inwardly facing surfaces of depending guide flanges 56 or 57 in a single-track carrier.

The motor 76 has a drive shaft 98 that extends through the casting 90 and connects to a pulley 100. The motor and pulley drive the wheel 70 through an intermediate pulley assembly 102 comprised of a larger pulley 103 and a smaller pulley 104, secured together for rotation on an intermediate shaft 105 secured to the casting. A first belt 106 from the motor shaft pulley 100 drives the larger pulley 103, which in turn drives the smaller pulley 104. A second belt 107 from the pulley 104 drives a larger pulley 109 on a drive axle 110 of the wheel 70. The wheel 70 has a non-metallic outer surface, for example, a solid plastic tire 112 of cylindrical contour.

Four guide rollers on vertical shafts are supported by the casting 90, two rollers 114, 115 on extending ears 116, 117 at the top of the casting, above and aligned in the direction of the track with the wheel 70, positioned to ride within the channel 62; and two guide rollers 120, 121 adjacent to the middle of the casting 90, just above the upper horizontal flange 94 and located to the outside of the track, positioned to ride against the outer surface of the depending track flange 56, each supported on a laterally extending ear 122, 123. The guide rollers serve to stabilize the carrier in the event the load should swing, or when the carrier moves around curved sections of the track.

The idler head 78*a* is comprised of a metal casting 126 that supports the load bearing idler wheel 71 journaled in a bearing 127 at the upper portion of the casting. The wheel 71 projects laterally from the casting to be received on the track support surface 50 while the casting is alongside the track. The casting has two upper guide rollers 124, 125 on ears 128, 129 opposite the guide rollers 114, 115 and that cooperate with the track channel 63. The casting has two vertically spaced parallel horizontal flanges 130, 131 that extend toward the center of the track, beneath the track and horizontally aligned with the flanges 94, 95 of the driven head. Two guide rollers 132, 133 are carried on the flange 130 at each lateral side of the casting to cooperate with the outside surface of the guide flange 57. The horizontal casting flanges 94, 95, and 130, 131 have the dual purpose of interconnecting the idler head and the drive head together through the adapter 80, and supporting additional guide wheels to cooperate with the inside surface of the depending track flange 56 or 57 in a single track application, as will be described in connection with FIGS. 11 to 17. As shown, the flanges 94, 95 and 130, 131 are in parallel, horizontal planes and are slightly spaced from each other at the the center of the track.

The adapter 80 for interconnecting the drive head and idler head, and the manner in which the heads are connected, are best shown in FIGS. 5 and 7 to 9 of the drawings. As shown in FIG. 5, the top flange 94 of the drive head has three lobes 94*a*, 94*b*, 94*c*, each with holes 134, 135, 136. The bottom flange 95, as illustrated in dotted line in FIG. 5, is in the form of a central lobe with a hole 138 (FIG. 8) aligned vertically with the hole 135. Similarly, the flange 130 of the idler head 78*a* has lobes 130*a*, 130*b*, and 130*c* with holes 140, 141, 142, and the lower flange 131 is in the form of a central lobe with a hole 144 aligned with the hole 141.

The adapter 80, as best shown in FIGS. 2 and 5–9, is between the drive head 74 and idler head 78*a*, is located in the space between the flanges 94, 95 and 130, 131, and extends a longitudinal distance somewhat greater than the distance between the lobes 94*a*, 94*b* of the drive head flange and 130*a*, 130*b* of the idler head flange. One end 80*a* extends beyond the castings of the drive and idler heads, and is adapted to support a bumper (not shown) for the carrier. The opposite end 80*b* serves as a tongue, constructed to be secured to the clevis 87 of the load bar 52. The adapter 80 has two large lobes 80*c*, 80*d* on opposite lateral sides. The lobe 80*c* fits between the flange lobe 94*b* and the flange 95 of the drive head. The lobe 80*d* fits between the flange lobe 130*b* and the flange 131 of the idler head. The lobe 80*c* has a hole 146 (FIG. 8) that is aligned with the holes 135 and 138 of the drive head flanges, and the lobe 80*d* has a hole 147 aligned with the holes 141, 144 of the idler head flanges. The thickness of each lobe 80*c*, 80*d* is substantially equal to the distance between the flanges 94, 95 and 130, 131 to avoid any relative vertical movement between the adapter 80 and the heads. Two additional lobes 80*e*, 80*f* extend laterally from the adapter, located to underlie the lobes 94*a*, 130*a* of the flanges 94, 130, and each has a hole 150, 151 (FIG. 7) aligned with the holes 134, 140.

Figure 7:
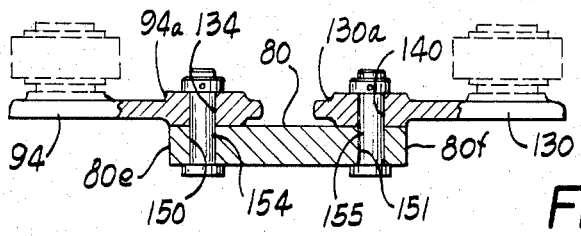
FIG. 7 is a sectional view taken along the line 7—7 of FIG. 6.
Figure 8:
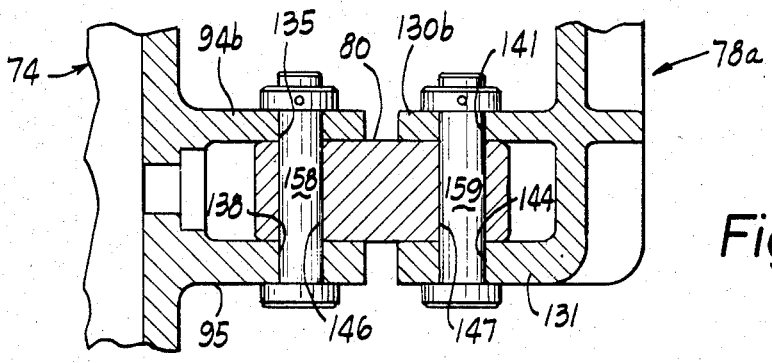
FIG. 8 is a sectional view taken along the line 8—8 of FIG. 6.
Figure 9:
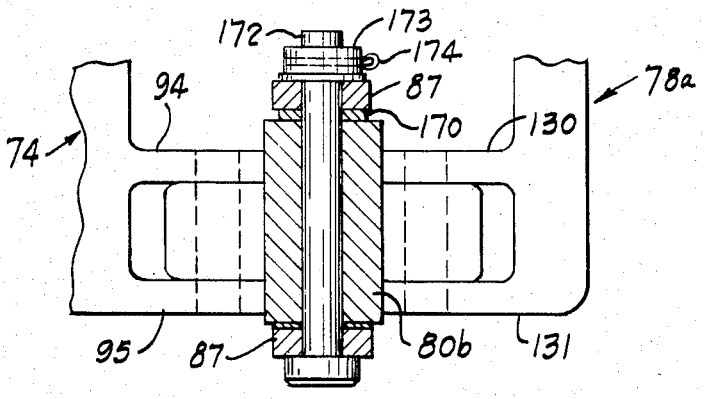
FIG. 9 is a sectional view taken along the line 9—9 of FIG. 6.

As best shown in FIGS. 7 and 8, two pins 154, 155 join the adapter 80 and the flanges 94, 130 at the lobes 94*a*, 130*a*; and two pins 158, 159 join the adapter 80 and the flanges 94, 95 of the drive head and flanges 130, 131 of the idler head at the lobes 94*b*, and 130*b*. Each of the pins has a head at the lower end and a retaining collar at the upper end, with a cotter pin extending through the collar and pin, which facilitates convenient disassembly.

The adapter end 80*b* is enlarged vertically with upper and lower bosses that extend above and below the upper and lower surfaces of the lobes 80*c*, 80*d*, by a distance sufficient that the end 80*b*, along with a thrust washer 170, fits closely between the ends of the clevis 87, which are long enough and separated sufficiently to clear the lobes 94*c*, 130*c* of the flanges 94, 130. See FIGS. 6 and 9. The clevis is secured to the adapter by a pin 172 and a retaining collar 173 held by a cotter pin 174. The connection of the clevis is located close to the interconnecting pins 158, 159 so the force transmitted from the load bar to the adapter 80 is as close as possible to the central lobes 94*b*, 130*b* of the drive and idler heads, and hence close to alignment with the axles of the load carrying wheels 70, 71. The clevis allows the load bar to pivot relative to the adapter to accommodate movement of the carrier around curves.

Figure 3:
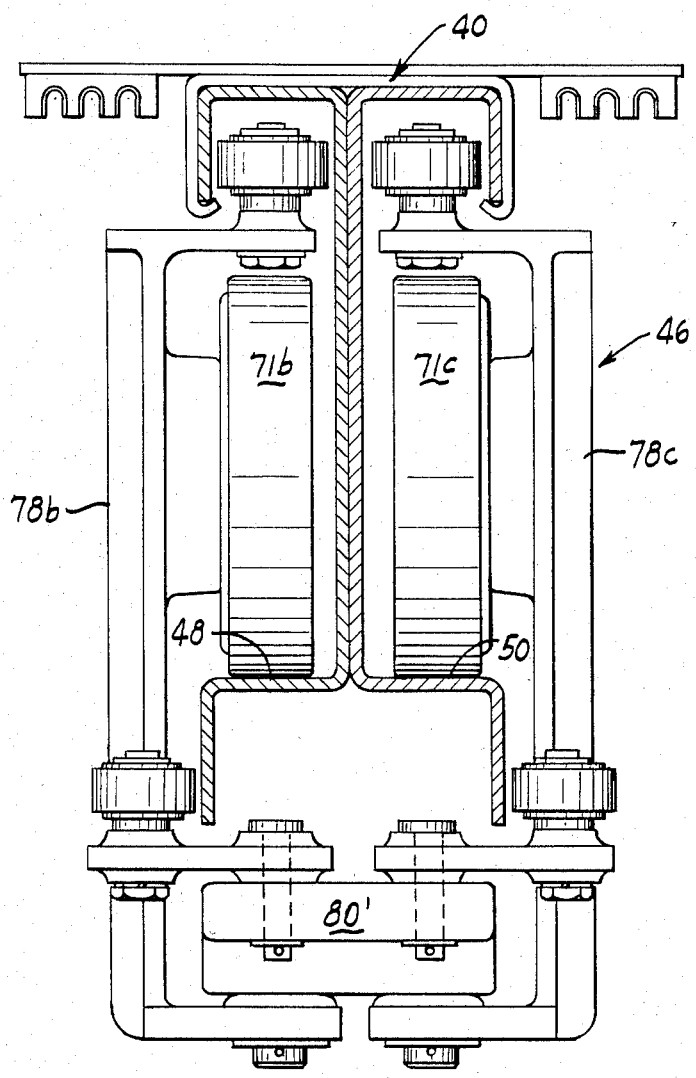
FIG. 3, is an end elevational view of a portion of the carrier of FIG. 1, taken along the line 3—3 of FIG. 1.

The interconnection of the idler heads 78*b*, 78*c* of the idler unit 46, shown in FIG. 3, is identical to that of the heads 74, 78*a*, except the tongue portion of the adapter 80′ extends in the opposite direction, toward the drive unit 44 to connect with the clevis on the opposite end of the load bar.

Two laterally spaced plates 181, 182 (FIG. 1) depend from the center of the load bar 52 midway between the drive and idler units, with transverse holes 183 for removably connecting a depending load, through the use of transverse pins, to the load bar.

Figure 10:
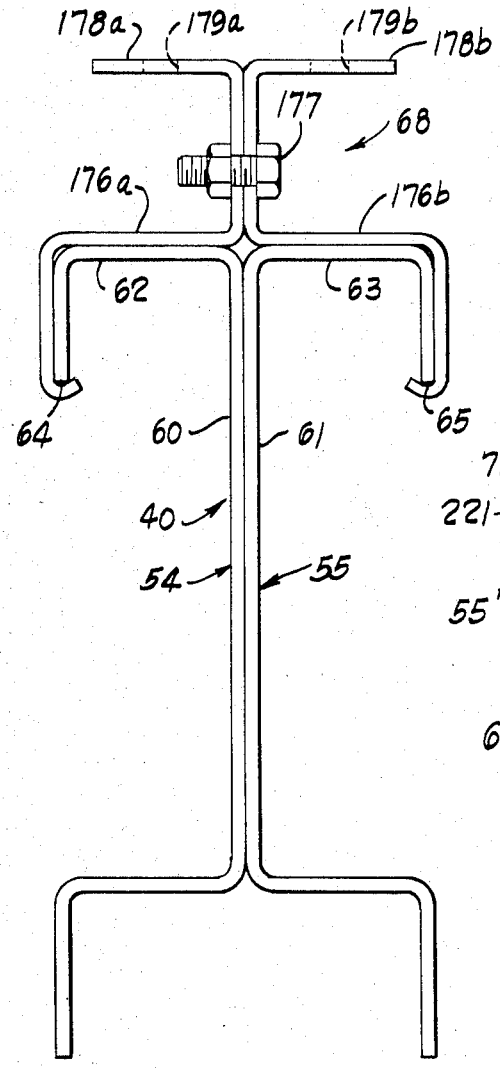
FIG. 10 is an end elevational view showing a double track and a suspension bracket.

FIGS. 1 and 10 illustrate a manner of suspending the track 40 with the clamp bracket 68, which is formed of two pieces 176*a*, 176*b*, each of which engages the track under an edge 64, 65 of a respective upper channel 62, 63. Two side-by-side bolts 177 clamp the two pieces together and upper flanges 178*a*, 178*b* are bolted to an overhead support, such as a beam or the like through holes 179*a*, 179*b*.

Six electrical conductors 184 (FIGS. 1 and 2) are carried by the track 40, from a horizontal, transversely extending, bracket 185. Three conductors extend along each side of the track in a horizontal plane adjacent the upper channels 54, 55, supported in insulating blocks 189. Two of the conductors provide power, one is a ground, and three carry control signals. The bracket 185 is secured by a snap-on channel portion 186 from which a horizontal portion 187 extends laterally beyond each side of the track. The conductors are U-shaped in cross section and current collectors 188 ride in the U-shaped grooves. The collectors on each side of the track extend from a spring-biasing shaft 190 secured at the upper end of an upstanding bracket 192 (FIG. 1). The brackets 192 are supported on each side of the idler unit 46 by a horizontal plate 194 secured to the bottom of the idler unit. A control box 196 for the drive motor is suspended from the plate and control circuits within the box are connected to the current collectors by wires 198. Operation is under control of circuit switches along the track operated by trippers (not shown) on the carrier, and a microprocessor. The conductor bars are arranged in electrically isolated sections along the track so that power and control signals can be selectively provided based on the carrier location. A control cable (not shown) from the control box 196 to the motor 76 supplies current to the motor and brake.

A second embodiment of a track and carrier system of the monorail type is shown in FIGS. 11 to 17 of the drawings. It is comprised of a single track 55' and a carrier 204 having a drive head 74' and an idler head 78' connected in tandem, each with a single load-carrying wheel 70', 71', riding on the same track surface 50'. A load bar 206 connects the drive head and idler head and supports a load between the two. The drive head 74' with its motor 76' is the same as the drive head 74, and the idler head 78' is the same as the idler heads 78*a*, 78*b*, 78*c*, except in both cases for the addition of two guide rollers 208, 209 and 210, 211 on each head, arranged relative to guide rollers 120', 121' and 132', 133' so that each head has guide rollers on both sides of the depending guide flange 57'. The single track 55' is the same as the individual track members 54 or 55 of the double track 40 of the first embodiment. This single track and carrier system has one-half the load carrying capacity of the system of the first embodiment, because only one-half of the track structure is used and the carriers have half of the number of load-carrying wheels as the first embodiment.

Because the drive head 74' and idler head 78' are identical to the drive head and idler heads 74, 78 (*a,b,c,*) already described, except for the addition of two guide rollers on each head, only the idler head 78' will be described in detail. It should be understood that the additional guide rollers on the drive head are identically constructed and arranged to those on the idler head.

Figure 13:
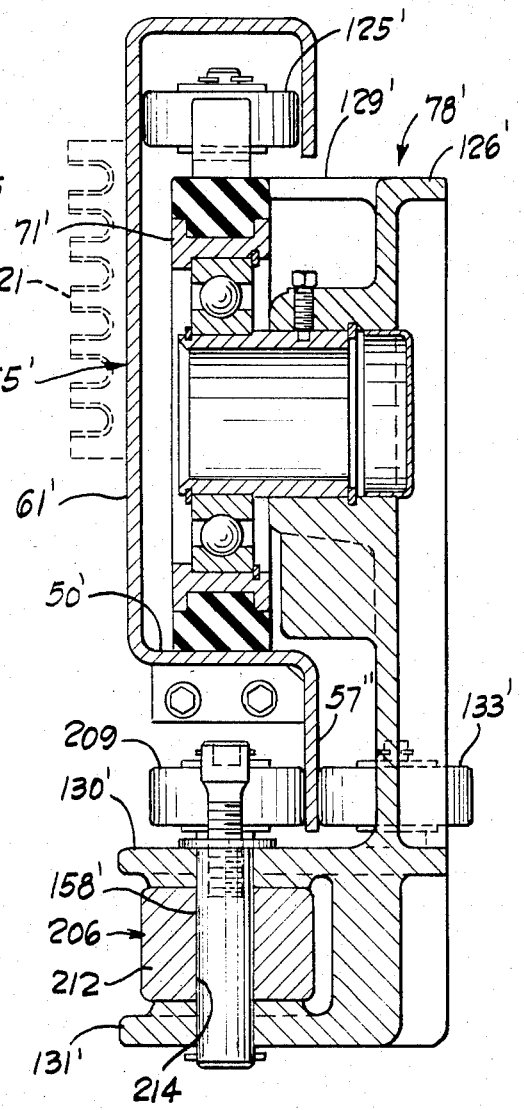
FIG. 13 is a sectional view of the idler head of FIG. 11, taken along the line 13—13.
Figure 11:
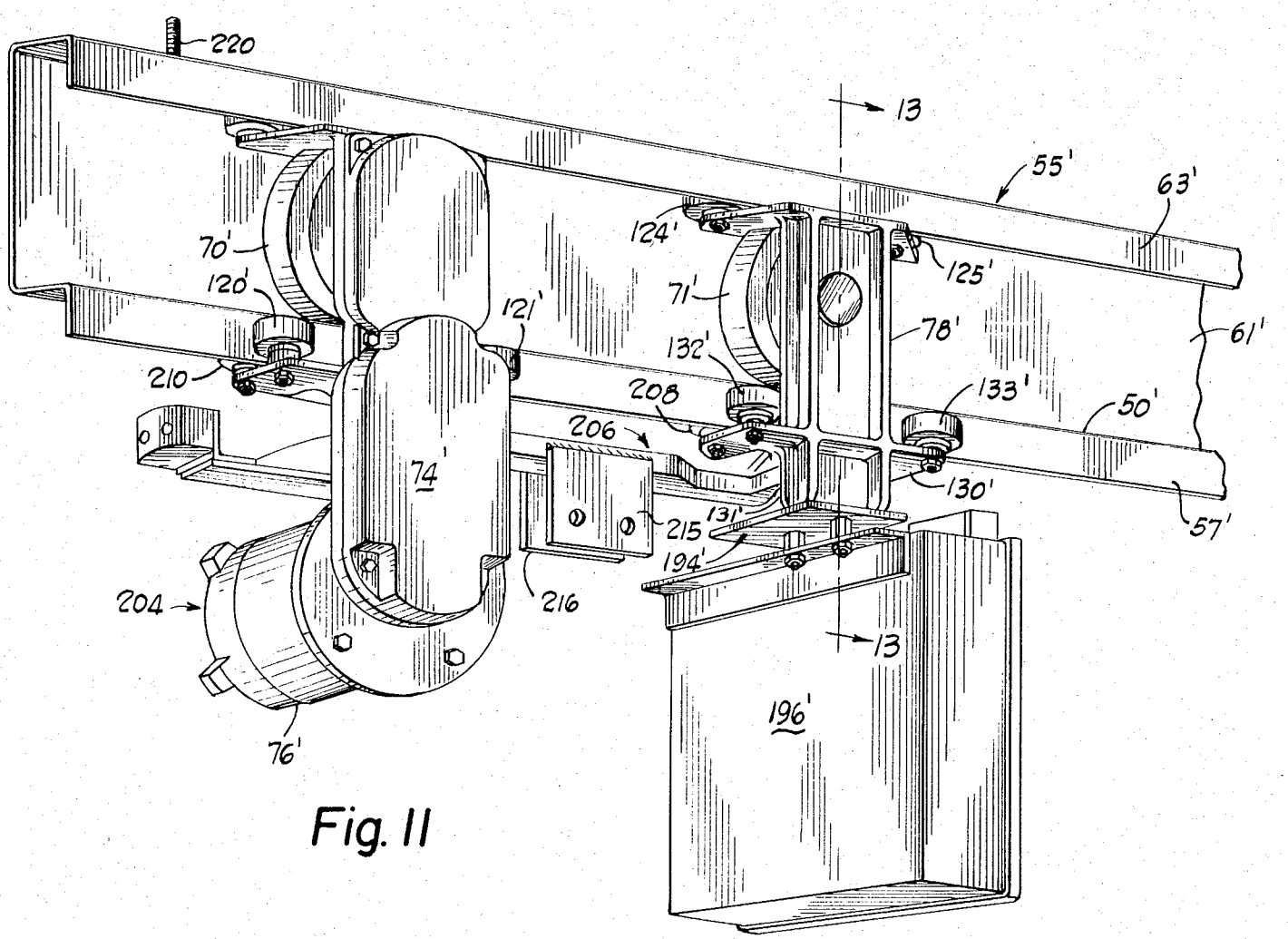
FIG. 11 is a perspective view, partly diagrammatical, of a single track system embodying the present invention.
Figure 12:
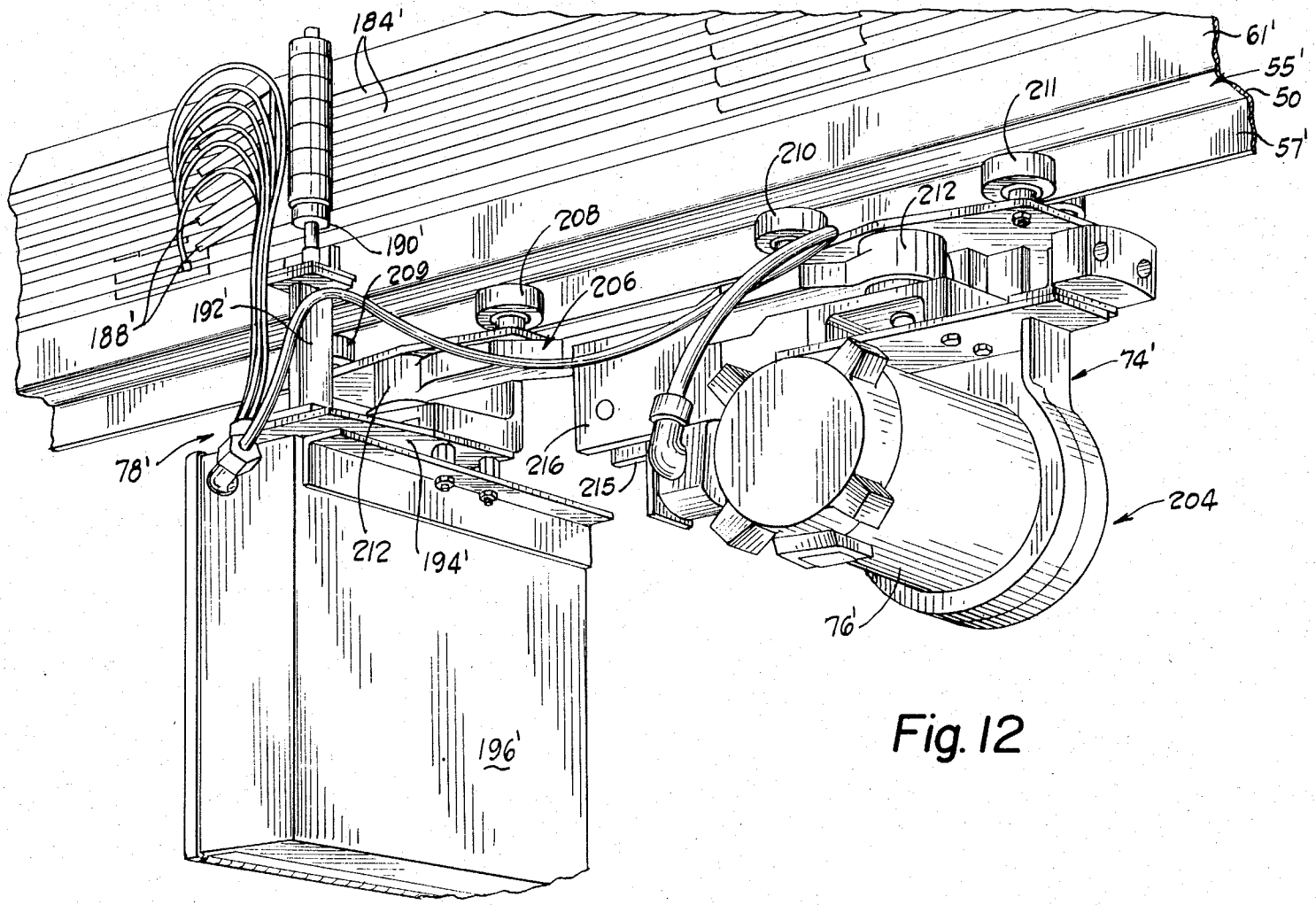
FIG. 12 is a perspective view of the system shown in FIG. 11, viewed from the opposite side.
Figure 14:
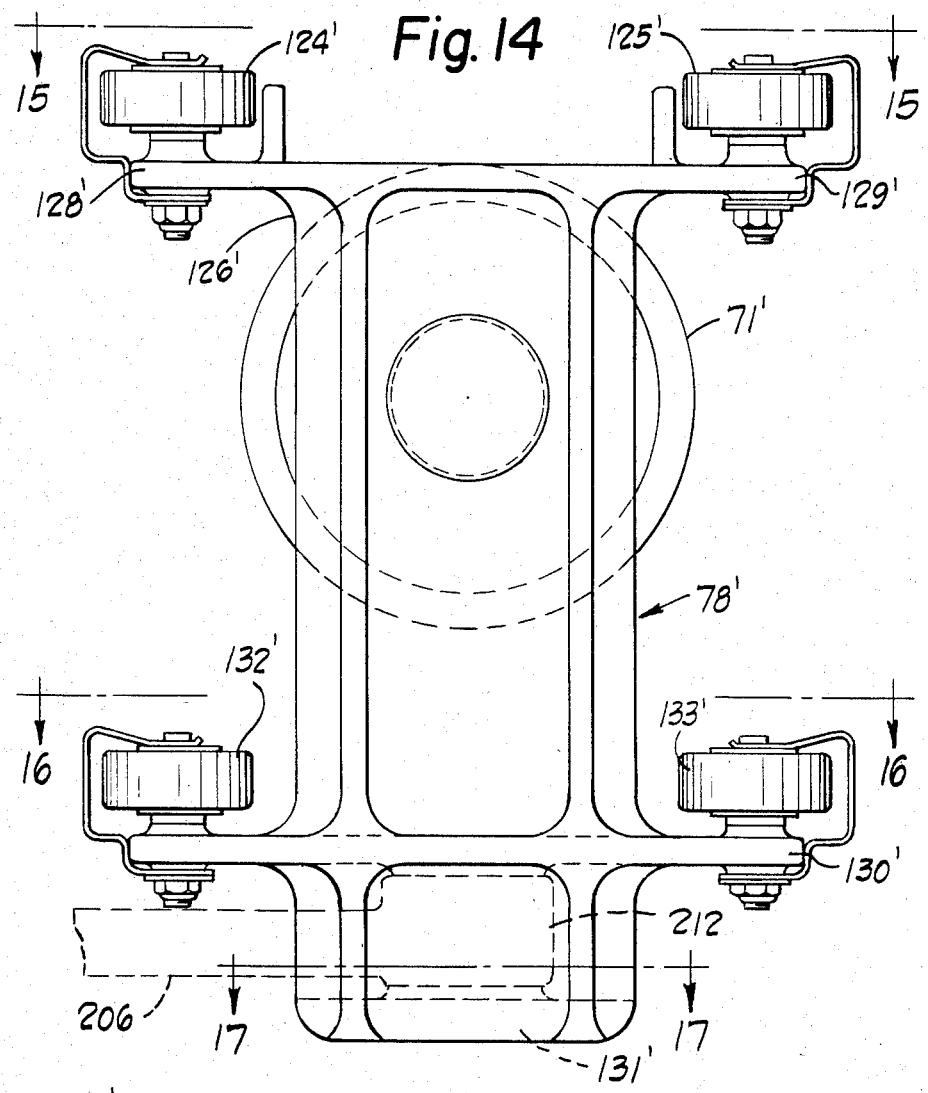
FIG. 14 is a side elevational view of the idler head of FIG. 11.
Figure 15:
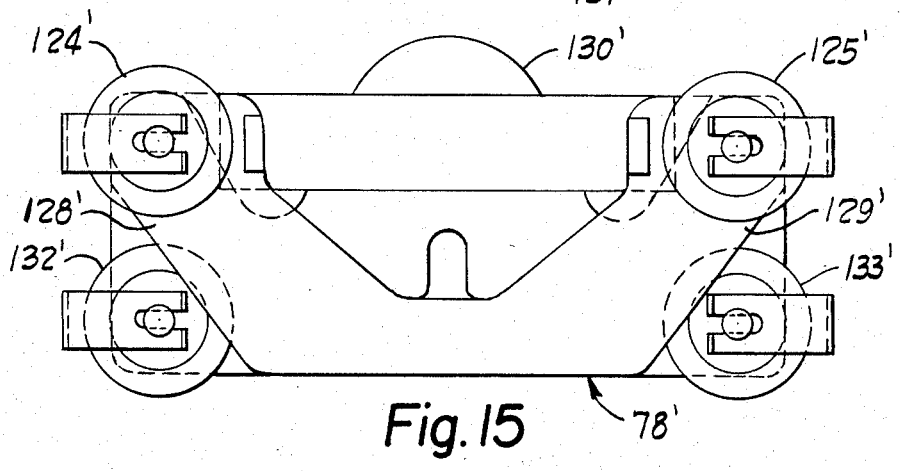
FIG. 15 is a top plan view of the idler head of FIG. 14 taken from the line 15—15.
Figure 16:
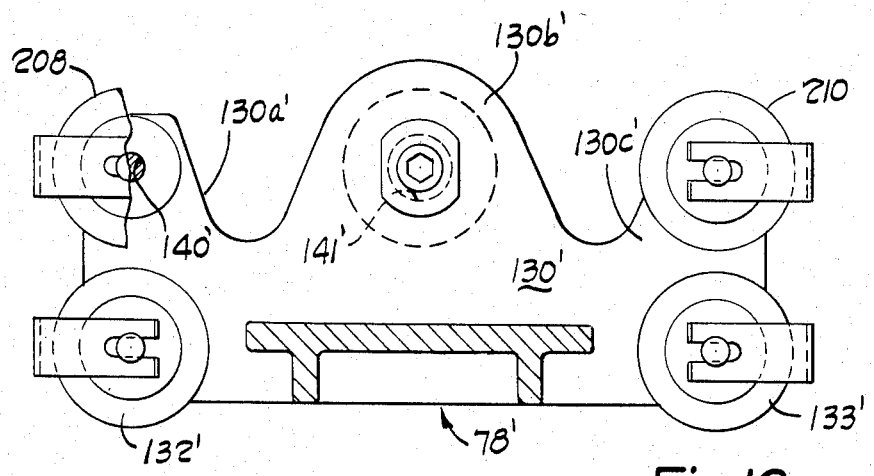
FIG. 16 is a sectional view taken along the line 16—16 of FIG. 14.
Figure 17:
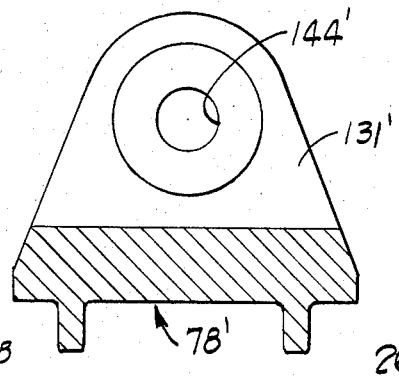
FIG. 17 is sectional view taken along the line 17—17 of FIG. 14.

As shown in FIG. 13, the idler head 78' is comprised of a metal casting 126' that supports the load bearing idler wheel 71' journaled at the upper portion of the casting. The wheel 71' projects laterally from the casting to be received on the track support surface 50' while the casting is alongside the track. The casting has two vertically spaced parallel horizontal flanges 130', 131' that extend beneath the track. The flange 130' has three lobes 130*a'*, 130*b'*, 130*c'*. In addition to supporting guide rollers 132', 133' which correspond to the guide rollers 132, 133 of the idler heads 78*a*, *b,c*, the flange 130' also supports the additional guide rollers 208, 209 (FIGS. 12, 13 and 16) on vertical shafts supported on flange lobes 130*a'*, 130*c'*. The shafts are secured in holes in the lobes, corresponding to the holes 140, 142 of flange 130, one of the holes 140' being shown in FIG. 16. The rollers 208, 209 are in the same horizontal plane as the guide rollers 132', 133' and are spaced laterally therefrom a distance slightly greater than the thickness of the depending guide flange 57' of the track. The central lobe 130*b'* has a hole 141' aligned with a hole 144' of the lower flange 131'. Both holes receive a pin 158' (FIG. 13) for securing the load bar 206, which has an enlarged boss 212 at each opposite end each with a hole 214 for receiving the respective pin 158' of the idler head or drive head. The boss fits closely between the flanges 130', 131' and the pin connection allows the bar to pivot relative to the head, allowing the carrier to travel around curves. The load bar has an irregular shape in plan, as shown in FIGS. 11 and 12, to facilitate pivoting of the drive and idler heads relative to the bar. It has two laterally spaced depending plates 215, 216 with transverse holes for securing a depending load, as with cross pins.

Upper guide rollers 124', 125' are carried by vertical shafts supported by the casting 126' on extending ears 128', 129' at the top of the casting, above and aligned in the direction of the track with the wheel 71', positioned to ride within the channel 63'.

As shown in FIG. 11, the track 55' is supported from the upper channel 63' by threaded studs 220 extending through holes in the channel and having headed ends received within the channel, above the path of movement above the upper guide rollers within the channel.

As best shown in FIG. 12, the vertical web 61' serves to support six conductor bars 184', which extend along the web on the opposite side thereof from the wheel-supporting surface 50'. The conductors are supported by suitable insulating brackets 221 (FIG. 13). The idler head 78' carries a horizontal support plate 194', secured to the bottom of the head. The plate supports a control box 196' and an upwardly extending bracket 192' on which are mounted six current collectors 188', which are urged by a spring biasing shaft 190' to ride along the conductor bars, to power and control the drive head 74'.

From the foregoing description of the embodiment of FIGS. 1 to 10 and the embodiment of FIGS. 11 to 17, it will be apparent that the drive heads 74, 74' and the idler heads 78, 78' can be used for either a carrier with side-by-side wheels or a carrier with single-wheels in tandem, along with the appropriate track by using or not using the additional guide rollers provided on the heads 74', 78', such as 208, 209, 210, and 211 that ride against the back of the flanges 57, 57' and by selecting the manner and arrangement of interconnection. Different current collector brackets and arrangements, as shown, facilitate the different location of the conductor bars for the double track and single track, although it will be apparent that the single track arrangement could utilize conductor bars supported by a bracket similar to that used for the double track. However, the compactness, stability, and simplicity of the mounting arrangement of the conductor bars on the web of the single track, made possible by the support of the track from overhead hangers connected to the upper channel, is advantageous. In addition, the different load bars 52 and 206 facilitate the different manner of coupling, i.e., directly between the drive and idler heads of the single wheel embodiment, and between adapters 80, 80' for the double-wheel units.

Because the double track 40 is comprised of single track members 54, 55, which alone are used for the single track embodiment, only a single track member need be manufactured and stocked. Duplicate single members are welded back-to-back at the webs, to form a double track. Preferably, the track members are roll-formed from steel sheet. A single-track member is rigid, due to the cross sectional shape, which provides a substantial section modulus. Substantially increased ridigity is of course obtained when two such track members are welded together and as a result the double track and two-wheel carrier units can be used in crane systems as well as in overhead monorail installations.

The track construction provides guide surfaces above and below the horizontal supporting surface, to stabilize the position of a carrier, especially a single wheel carrier. The support wheels 70, 71 have cylindrical running surfaces to minimize wear and chatter, especially when the carrier travels around curves. The running surfaces are of non-metallic material such as a hard plastic, for quiet running and good traction. In contrast, wheels having concave running surfaces that travel along convex rails experience wear and chatter when travelling around curves. In addition, the present track shape, being flat to accomodate the cylindrical surfaces of the wheels, does not collect dirt, and the track is easily cleaned. This important in a dirty environment and in food handling applications.

Figure 33:
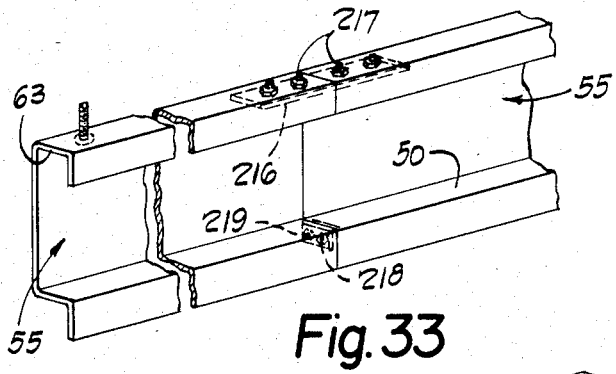
FIG. 33 is a partial perspective view of a single track illustrating the manner of joining sections and suspending the track.
Figure 35:
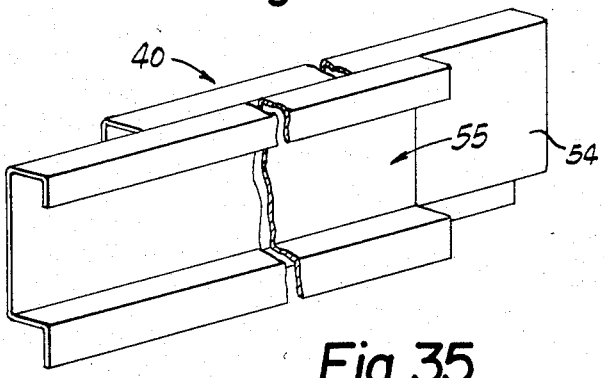
FIG. 35 is a perspective view of a section of double track illustrating an offset arrangement to facilitate joining sections.

As illustrated in FIG. 33, two aligned sections of single track 55 are connected by abutting adjacent ends and providing an elongated plate 215 across the juncture, within the channel-shaped portion 63 of the track. The plate has four upstanding threaded studs 216, two provided on each side of the juncture, aligned with holes through the channel portion of the track. Suitable nuts 217 secure the parts together. Also, small transverse blocks 218 are welded to the track beneath the support surface 50 directly adjacent the ends of each section. Thus, two such blocks are in face-to-face relationship at each juncture. The blocks have two holes side-by-side, that align with similar holes in the adjacent block, and fasteners 219 secure the sections together beneath the support surfaces 50. Where a double track 40 is used, the two track sections are preferrably offset longitudinally, as shown in FIG. 35, so the junctures between single track sections on one side are offset relative to the junctures of the single track sections forming the other side, providing staggered junctures and increased rigidity.

Figure 18:
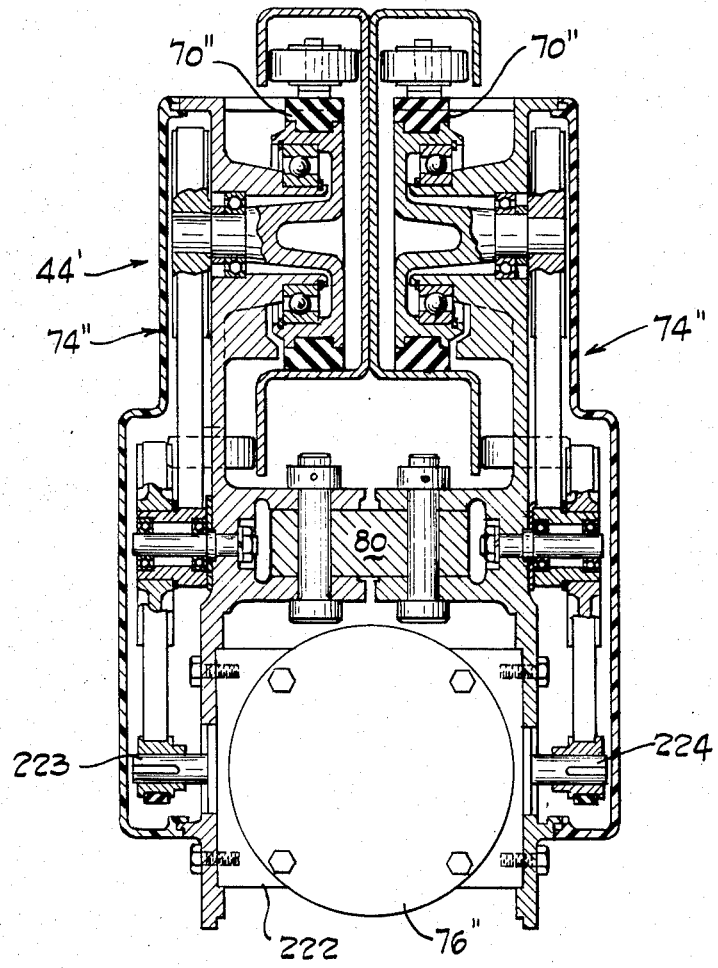
FIG. 18 is a view partly in elevation and partly in section of another embodiment of a motor driven unit of the present invention.

Another embodiment of the invention, utilizing features already described in connection with the embodiments of FIGS. 1 to 10 and 11 to 17, is shown in FIG. 18 of the drawings. A double-track carrier unit 44' is shown, with two drive heads 74'' to power both load supporting wheels 70'' through a motor 76'' and a differential gear box 222 having two drive shafts 223, 224. This arrangement assures that the two drive wheels can be operated at different speeds around turns while providing power to both wheels to carry heavier loads by virtue of the greater traction afforded by two driven wheels as compared to one. The two drive heads are connected by an adapter 80 in an identical matter to that in which the drive head 74 and idler head 79 are connected.

Figure 19:
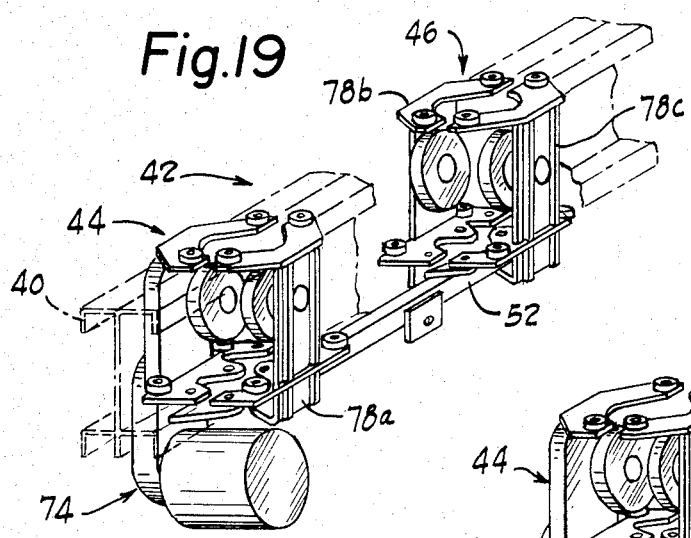
FIGS. 19–23 are diagrammatic views showing various combinations and arrangements of the drive heads and idler heads of FIGS. 1–18, illustrating how heads interconnected to form carriers having different load carrying capacity.
Figure 20:
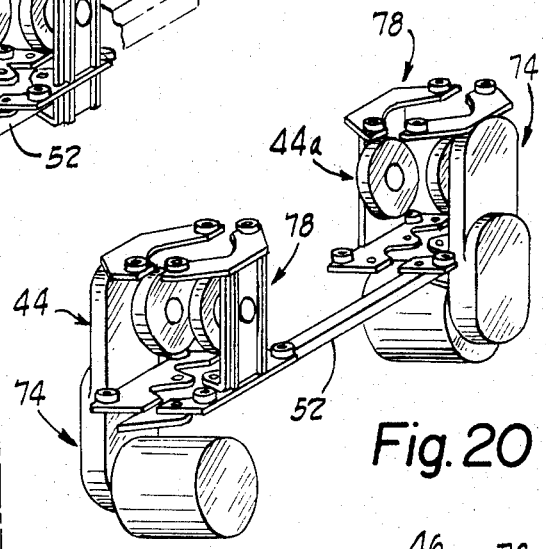
Figure 21:
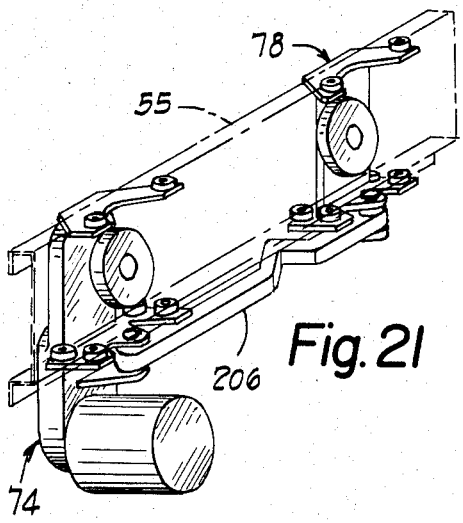
Figure 22:
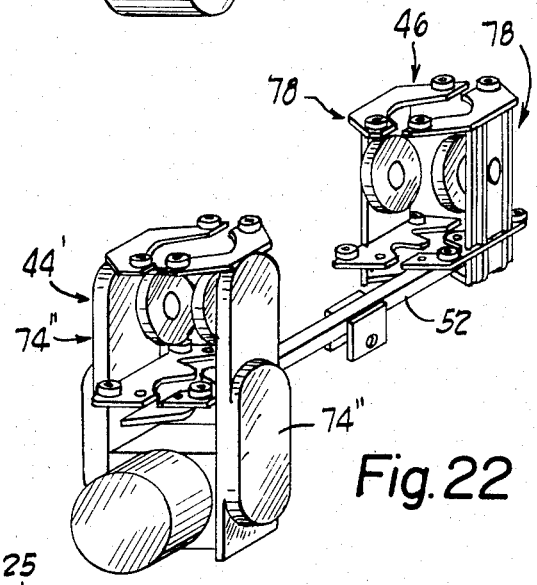
Figure 23:
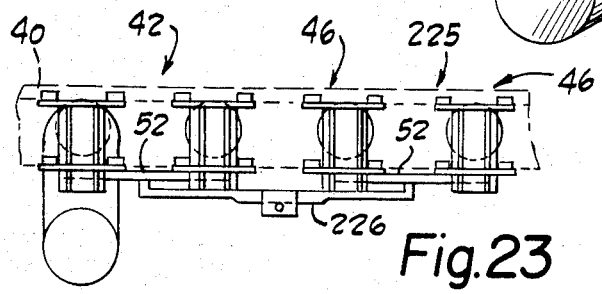

The above-described structures facilitate a wide variety of units suitable for carrying different loads, yet with a minimum of different parts. For comparison, a number of these units and the manner in which they may be combined are shown diagrammatically in FIGS. 19 to 23. FIG. 19 illustrates the embodiment of FIGS. 1 to 10, i.e., a carrier system with a double track 40, a drive unit 44 with a drive head 74 and an idler head 78*a*, and an idler unit 46 comprised of two idler heads 78*b*, 78*c*. FIG. 20 shows a double-track carrier system with two drive units 44, 44*a*, each comprised of a drive head 74 and an idler head 78. The drive unit 44 is identical to that of FIG. 19, while the drive unit 44*a* has its drive head on the opposite side of the track from the drive head of unit 44. As a result, a driven support wheel is provided on both sides of the rail for a balanced drive. FIG. 21 illustrates the embodiment of FIGS. 11 to 17, utilizing a single track 55 with a drive head 74 and an idler head 78 in tandem. FIG. 22 illustrates the embodiment of FIG. 18, with two drive heads 74'' forming a drive unit 44' having two drive wheels, and two idler heads 78 forming an idler unit 46. FIG. 23 illustrates a double track and double carrier comprised of a first carrier 42, as in FIG. 19, with an interconnecting load bar 52, and a second carrier 225 comprised of two idler units 46 connected by a second load bar 52, the two load bars 52 interconnected by a load bar 226. This arrangement provides double the load carrying capacity of the carrier unit of FIG. 19. It will be apparent that the first carrier 42 of FIG. 23 and the second carrier 225 could be replaced by the carrier of FIG. 20 or the carrier of FIG. 22 to provide additional driving traction and power.

A modified embodiment of a drive head and idler head is shown in FIGS. 24 to 32 of the drawings. This embodiment has the same features and advantages of the embodiments of FIGS. 1 to 10 and 11 to 17, but varies slightly in construction.

Figure 24:
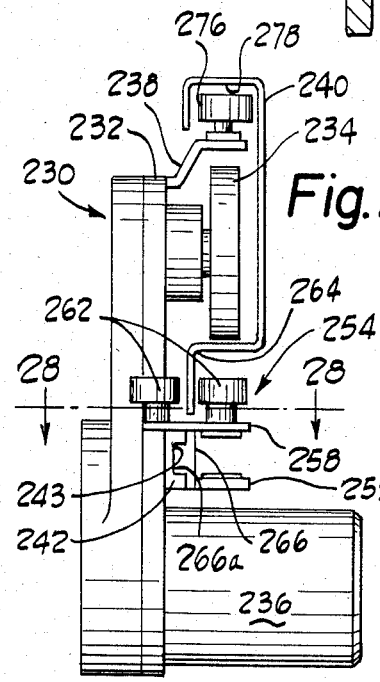
FIGS. 24–32 are diagrammatic views of drive heads and idler heads for use on a single track or double track, illustrating embodiments of the invention, and in which, more specifically.
Figure 25:
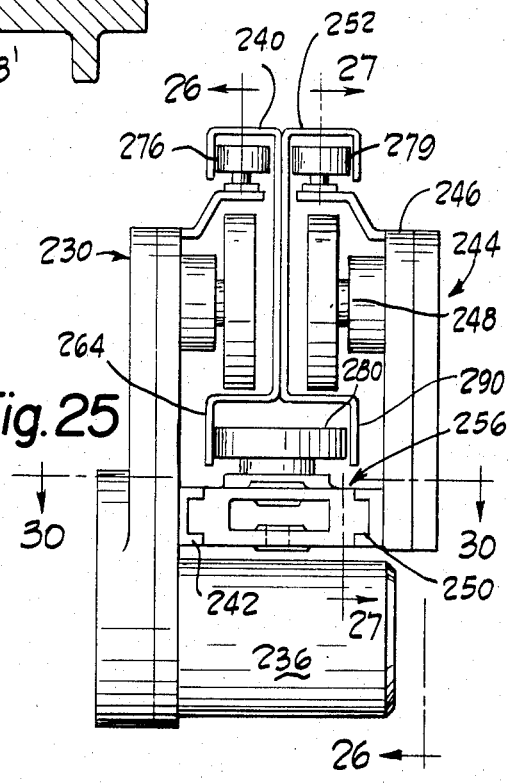
Figure 26:
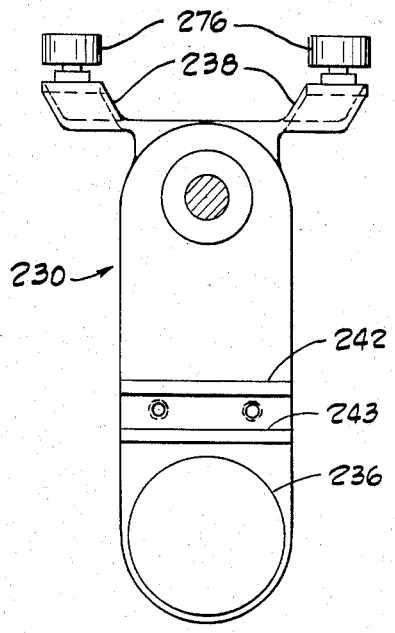

A drive head 230 is shown in FIGS. 24, 25 and 26, comprised of a casting 232, a load supporting drive wheel 234 adjacent the upper portion of the casting, a drive motor 236 adjacent the lower end of the casting, and an upper guide roll support flange 238 extending from the upper end of the casting. The head is shown supported on a single track 240 identical to the track member 54. In the above respects, the drive head 230 is identical to the drive head 74. However, instead of having parallel flanges 94, 95, it has an adapter-receiving bracket 242.

Figure 27:
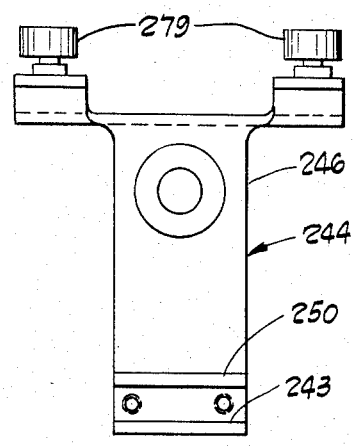
Figure 28:
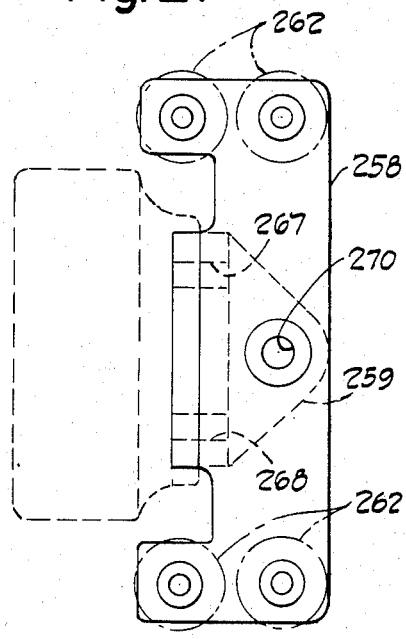

An idler head 244 of this embodiment is shown in FIGS. 25 and 27. It is comprised of a casting 246, a load supporting idler wheel 248 at the upper portion, and instead of parallel flanges 130, 131 as in the embodiment of FIGS. 1 to 10, it has an adapter-receiving bracket 250 at the lower portion of the casting, facing inwardly of a supporting track 252 laterally spaced from, horizontally aligned with, and opposed to the adapter-receiving bracket 242 of the drive head 232. FIG. 24 shows the drive head 230 in a single track application, while FIG. 25 shows the same drive head 230 and the idler head 244 in opposed relationship, interconnected to form a double-wheel unit for use on a double track comprised of two single track members 240, 252.

The adapter-receiving brackets 242, 250 are identical, and as shown are channel-shaped, constructed to locate and support one of two adapters 254, 256.

The adapter 254 is a removable piece with two vertically-spaced, parallel, horizontal flanges 258, 259, similar to the flanges 94, 95 of the drive head 74, and similar to the flanges 130, 131 of the idler heads 78. The flange 258 carries four guide rollers 262, aligned in pairs, so in use two are located on each side of the depending flange portion 264 of the track 240. The adapter 254 is used on a drive head or idler head in a single-track application. A central structure 266 of the adapter, which supports the flanges 258, 259, has a horizontal tongue 266*a* received within a groove 243 of either adapter-receiving bracket 242, 250 and is secured with bolts through holes 267, 268 (FIGS. 28 and 29) and threadedly received in the adapter 242 or 250. A central hole 270 in the flange 258 is aligned with a hole 272 in the parallel lower flange 259, the two holes being adapted to receive a pin for securing the end of a load bar 274 to the unit between the flanges. It will be appreciated from the description of the previous embodiments that the load bar connects in the same manner to an idler head in tandem, riding on the same track 240.

Two guide rollers 276 are secured on vertical shafts to the upper guide roller supporting flange 238, and ride within an upper channel 278 of the track, to stabilize the carrier. The same is true of guide rollers 279 of the idler head.

Figure 30:
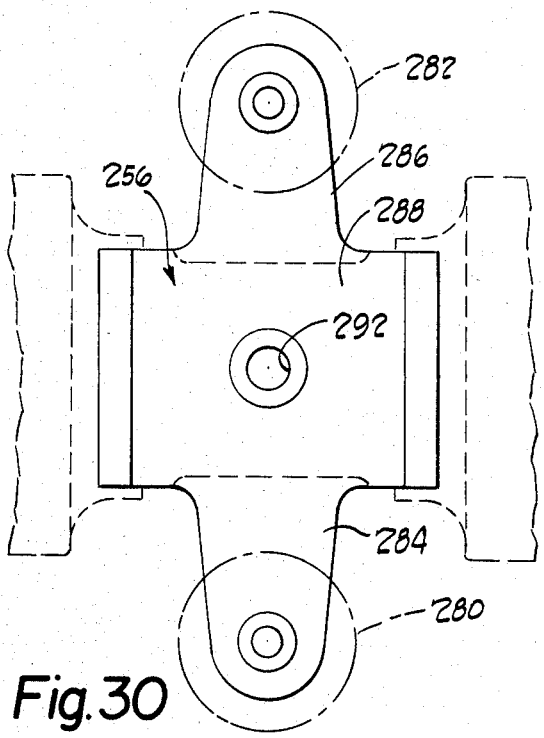
Figure 29:
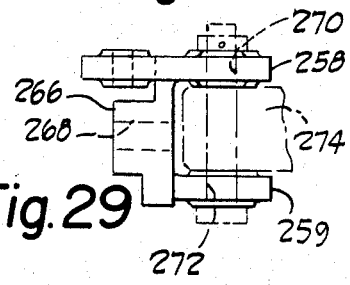
Figure 32:
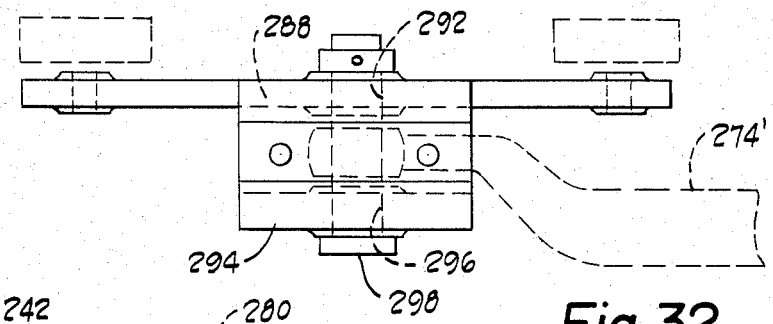
Figure 31:
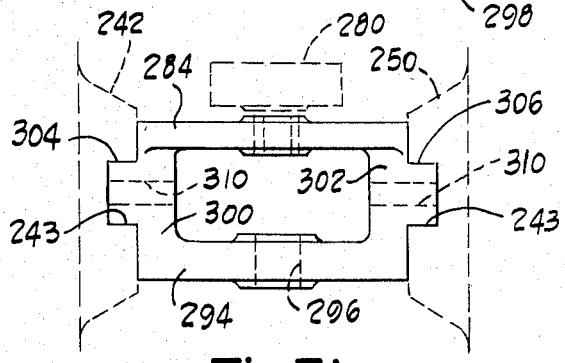
Figure 34:
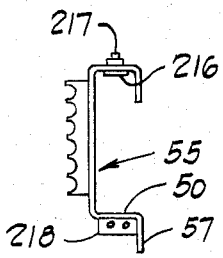
FIG. 34 is an end elevational view of a section of the track of FIG. 33 taken from the left end.
Figure 36:
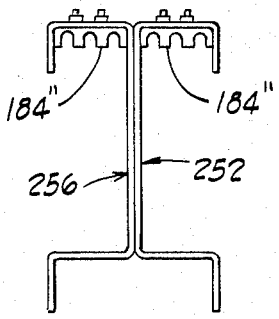
FIG. 36 is an end elevational view of a double track, illustrating a modified location of conductor bars.

The adapter 256, shown in FIGS. 25, 30 and 31 is removably attached at opposite sides to opposed heads, such as a drive head 230 and an idler head 244, and serves to connect or link the two heads together. It has two large, aligned, guide rollers 280, 282 on horizontal ears 284, 286 extending forward and back from an upper horizontal central web 288 of the adapter. The diameters of both rollers 280, 282 are the same, and slightly less than the distance between the depending track flanges 264 and 290. These relatively large-diameter guide rollers provide stability against motion in both transverse directions with respect to the track extent. As a result, upper guide rollers 276, 279 are preferrably omitted from the heads, leaving the upper track channels free to carry conductor bars 184'' if desired as illustrated in FIG. 36.

The upper central web portion 288 (FIG. 32) of the adapter has a central hole 292, and a lower horizontal central web 294 has a hole 296 aligned with the hole 292. Both of the holes receive a pin 298 that extends through and secures the end of a load bar 274' that fits in the space between the webs 288 and 294. Side walls 300 and 302 (FIG. 31) connect the upper and lower webs 288, 294 and have parallel tongues 304, 306 on outer surfaces received in mating grooves 243 of the adapter-receiving brackets 242, 250 of each facing head. Transverse holes 310 in side walls 300, 302 receive bolts that are secured in threaded holes in the grooves 243. Side walls 300, 302 are laterally spaced sufficiently to allow clearance for the load bar 274' to pivot relative to the adapter, thereby facilitating travel of the carrier about curves.

It will be appreciated from the foregoing that the construction of the embodiment of FIGS. 24 to 32 allows a drive head and an idler head to be connected in a variety of ways and in various combinations, just as in the foregoing embodiments illustrated in FIGS. 19 to 23, by the use of two different adapters 254, 256 and a single construction of a drive head and an idler head.

While preferred embodiments of the invention have been disclosed in detail, it will be understood that various modifications and alterations may be made therein without departing from the spirit and scope of the invention, set forth in the appended claims.

I claim:

1. Carrier construction for material handling systems in which either a carrier of a first arrangement, or a carrier of a second arrangement, is constructed to move along track means; the carrier construction comprising:

(a) first head means including first support-wheel means;

(b) second head means including second support-wheel means;

(c) first connection means carried by said first head means;

(d) second connection means carried by said second head means;

(e) first interconnection means releasably connectable to said first connection means and said second connection means to interconnect said first head means and said second head means in a first predetermined arrangement wherein said first head means and said second head means are disposed in tandem with their respective support-wheel means longitudinally aligned; and (f) second interconnection means releasably connectable to said first connection means and said second connection means to interconnect said first head means and said second head means in a second predetermined arrangement wherein said first head means and said second head means are disposed in lateral opposition with their respective support-wheel means axially aligned;

(g) said first head means and said second head means being interconnected either in said first predetermined arrangement by said first interconnection means or in said second predetermined arrangement by said second interconnection means.

2. The carrier construction of claim 1 wherein said first interconnection means and said second interconnection means are respectively connectable to said first connection means and said second connection means in a predetermined position located beneath the track means.

3. The carrier construction of claim 2 wherein said first interconnection means and said second interconnection means are releasably connectable to as well as releasably separable from said first connection means and said second connection means.

4. The carrier construction of claim 1 wherein said first head means and said second head means respectively include first guide wheel means disposed to coact with the track means and second guide wheel means disposed to coact with the track means such that said first head means and said second head means are separately supportable upon and movable along the track means.

5. The carrier construction of claim 1 wherein said second support-wheel means of said second head means is constructed and arranged to be power driven.

6. The carrier construction of claim 5 wherein said second support-wheel means of said second head means is constructed and arranged to be power driven.

7. The carrier construction of claim 6 including power drive mean connected to said first support wheel means and said second support-wheel means to drive same.

8. The carrier construction of claim 5 including:

(a) third head means including third support-wheel means;

(b) fourth head means including fourth support-wheel means;

(c) third connection means carried by said third head means;

(d) fourth connection means carried by said fourth head means; and (e) third interconnection means releasably connectable to said third connection means and said fourth connection means to interconnect said third head means and said fourth head means in lateral opposition with their respective support-wheel means axially aligned.

9. The carrier construction of claim 8 including link bar means releasably connectable to and interconnecting said third interconnection means to said second interconnection means to thereby interconnect said first head means and said second head means when interconnected thereby to said third head means and said fourth head means.

10. The carrier construction of claim 9 wherein said third support-wheel means of said third head means is constructed and arranged to be power driven.

11. The carrier construction of claim 10 wherein said third support-wheel means is disposed in opposed relationship to said first support-wheel means and is longitudinally spaced from said first support-wheel means.

12. The carrier construction of claim 11 including first power drive means connected to said first support-wheel means.

13. The carrier construction of claim 12 including second power drive means connected to said third support-wheel means.

14. The carrier construction of claim 1 wherein said support-wheel means and said second support-wheel means each include at least one load-supporting wheel and each of said load-supporting wheels have non-metallic cylindrical outer peripheries.

15. The carrier construction of claim 1 wherein said first connection means and said connection means each include a pair of vertically spaced flanges located on their respective head means to extend beneath the track means when said head means are located on the track means; and each of said pair of vertically spaced flanges are formed to receive therebetween at least a portion of either said first interconnection means or said second interconnection means.

16. The carrier construction of claim 15 wherein each of said pair of vertically spaced flanges include aligned holes and said first and said second interconnection means includes an opening formed and sized to be aligned with said aligned holes in said flanges and coupling pin means are disposed in said holes and openings to interconnect said connection means and said interconnection means.

* * * * *